US005234141A

United States Patent [19]

Spiece

[11] Patent Number: 5,234,141

[45] Date of Patent: Aug. 10, 1993

[54] GLOVE CONDITIONER

[75] Inventor: Walter L. Spiece, New Berlin, Wis.

[73] Assignee: Allen-Edmonds Shoe Corporation, Port Washington, Wis.

[21] Appl. No.: 954,484

[22] Filed: Sep. 30, 1992

[51] Int. Cl.[5] ..... A41D 1/00

[52] U.S. Cl. ..... 223/78

[58] Field of Search ..... 223/78, 79, 80, 66; 24/904, 3 J, 3 L; D6/325, 324, 326, 316, 327

[56] References Cited

U.S. PATENT DOCUMENTS

| | | | |
|---|---|---|---|
| 915,466 | 3/1909 | McBride | 223/80 |
| 1,173,955 | 2/1916 | Grueber | 223/80 |
| 1,569,283 | 1/1926 | Johnson | 223/79 |
| 2,554,825 | 5/1951 | Grimberg | D6/326 X |
| 2,783,925 | 3/1957 | Ross | 223/78 |
| 3,041,696 | 7/1962 | Ferri, Jr. | D6/326 X |
| 3,477,622 | 11/1969 | Appelt | 223/78 |
| 4,018,382 | 4/1977 | DiCuya | 223/78 |
| 4,565,287 | 1/1986 | Rede et al. | 223/78 X |

FOREIGN PATENT DOCUMENTS

| | | | |
|---|---|---|---|
| 2209658 | 9/1987 | United Kingdom | 223/78 |

*Primary Examiner*—Clifford D. Crowder
*Assistant Examiner*—Bibhu Mohanty
*Attorney, Agent, or Firm*—Andrus, Sceales, Starke & Sawall

[57] ABSTRACT

A conditioner for a golf glove is made from a piece of solid aromatic cedar cut generally to the shape of a hand and having a palm portion and at least three fingers extending therefrom. A manually operable spring clip is attached to the palm portion to receive the open edge of the glove which is slipped onto the fingers and over the palm portion to hold the glove in position and help retain its shape. A simple bead chain or other attachment device may be mounted on an extended portion of the conditioner to allow the device to be hung on a golf bag or the like.

7 Claims, 1 Drawing Sheet

FIG. 1
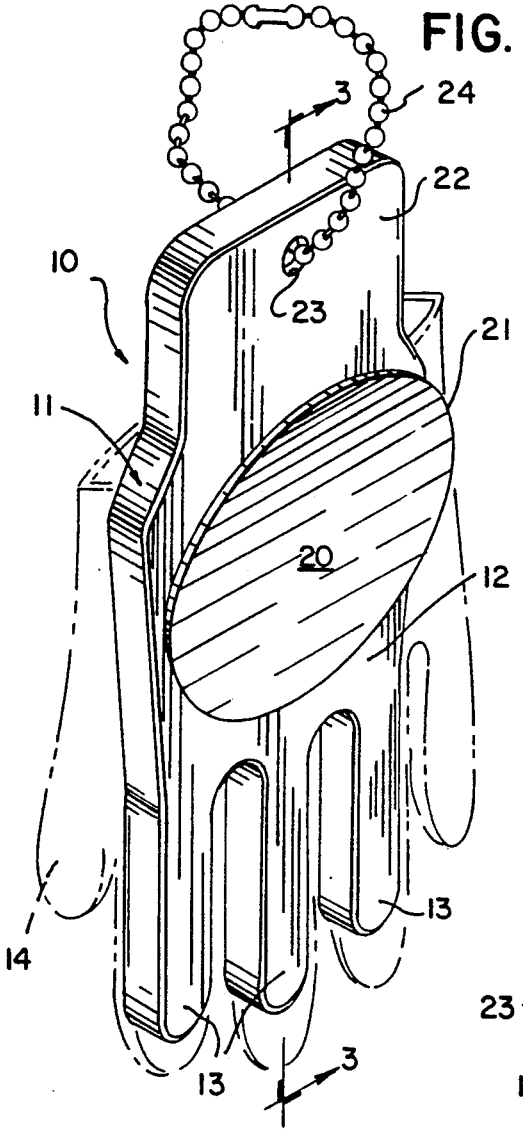
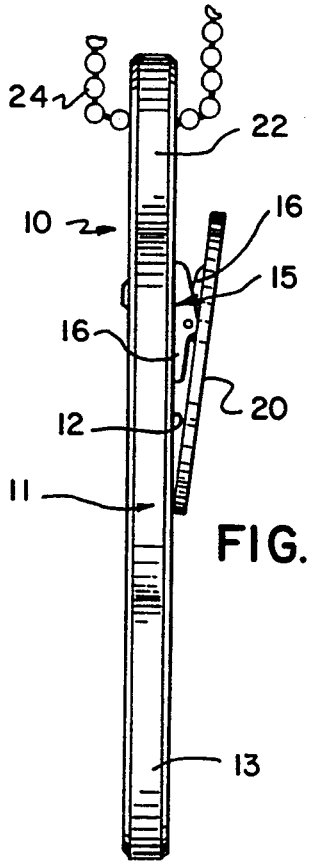
FIG. 2
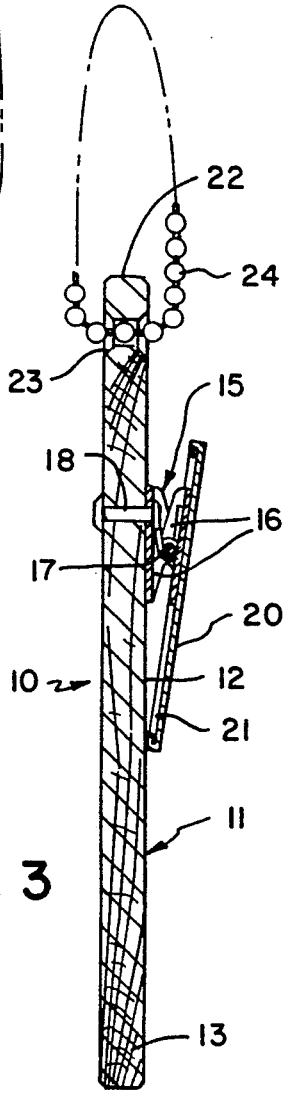
FIG. 3

GLOVE CONDITIONER

BACKGROUND OF THE INVENTION

The present invention pertains to a glove conditioning device and, more particularly, to a simple hand-shaped form over which a golf glove may be placed to retain its shape and facilitate drying.

Hand-shaped form devices for shaping and drying gloves are well known in the art. Such devices typically take the shape of a complete hand and include a palm portion, four fingers and a thumb. The prior art also discloses the use of different materials for making glove forms, including wire and solid metals, molded plastics, and combinations thereof. Some devices are completely rigid, while others are formable or articulating.

Examples of typical prior art glove forms are shown in U.S. Pat. Nos. D. 193,408; 2,783,925; and 4,018,382. These prior art patents show the use of molded plastic constructions and constructions using both plastic and metal. This prior art also shows simple one piece constructions, as well as more complex adjustable and articulating constructions in which the form may be adjusted to accommodate varying glove sizes.

Golfers often wear a single golf glove which may typically be made of leather and be fairly expensive in cost. The glove may become damp or wet in use from perspiration or precipitation and, when not in use, might typically be balled or rolled up and inserted in a pocket in a golf bag or the like. As a result, the glove will not dry properly, may become wrinkled and deformed, and prematurely crack and wear out. Above identified U.S. Pat. No. 4,018,382 describes a glove form which may be particularly adapted to accommodate a golf glove and includes means for attaching the glove form to a golf bag, golf cart or the like. However, the form is extremely complex in construction, bulky in shape, and likely very expensive to manufacture.

Therefore, there is a real need for a simple and inexpensive glove form which may be used to condition a golf glove by retaining its shape and facilitating drying.

SUMMARY OF THE INVENTION

In accordance with the present invention, a conditioner for a golf glove or the like provides a support for drying and retaining the shape of the same and includes a solid wooden body formed generally in the shape and to the size of a hand, which body includes a palm portion and a plurality of fingers extending from one edge of the palm portion. Manually operable clip means are attached to one side of the palm portion at a position remote from the fingers for receiving one edge of the open end of the glove and for holding the glove which is slipped onto the wooden body.

The body is preferably cut from a flat piece of wood and the fingers are positioned parallel to one another. In the preferred embodiment, there are three fingers adapted to accommodate the index, middle and ring fingers of the glove. The body is preferably made of aromatic cedar and also includes an extended portion formed integrally with and extending from the palm portion opposite the fingers. Attachment means are provided on the extended portion for hanging the conditioner on a support.

The clip means on the palm portion of the body preferably comprises a pivotable spring clip having one leg which is spring biased into holding contact with the palm portion. The leg may be provided with an outer surface portion to which indicia comprising printed and/or graphic material is affixed.

BRIEF DESCRIPTION OF THE DRAWINGS

FIG. 1 is a perspective view of the glove conditioner of the present invention showing in phantom a glove slipped thereover.

FIG. 2 is a side elevation of the glove conditioner shown in FIG. 1.

FIG. 3 is a sectional view taken on line 3—3 of FIG. 1.

DETAILED DESCRIPTION OF THE PREFERRED EMBODIMENT

A golf glove conditioner 10 is shown in FIG. 1 and is preferably cut or otherwise formed from a thin solid sheet of aromatic cedar wood. Obviously, other types of wood or other materials might also be used, but aromatic cedar is preferred because of its known deodorizing characteristics.

The body 11 of the glove conditioner is formed in a size and to the shape of a hand and includes a palm portion 12 and a plurality of fingers 13 extending from one end of the palm portion. The fingers 13 are preferably shaped and positioned to receive the index, middle and ring fingers of a conventional golf glove 14 which is slipped thereon and over the palm portion 12 as shown in FIG. 1. Both right and left handed gloves are readily accommodated.

Because the glove 14 may be damp and/or wrinkled, clip means is provided to hold the glove in position on the conditioner 10. The clip means preferably comprises a simple manually-pivotable spring clip 15 attached to one surface of the palm portion 12. The clip 15 includes two more or less conventional legs 16, one of which is attached to the palm portion by a rivet 18. The legs 16 are biased together by a torsion spring 17 so that the open edge of the palm portion of the glove 14 may be slid under the outer leg 16 and held in position to retain the glove on the conditioner in a relatively flat condition and to keep it from falling off. The outer leg 16 of the clip 15 preferably includes an extended outer surface portion 20, which in the disclosed embodiment, comprises a large flat button 21. The button provides the clamping function and the extended outer surface portion 20 provides a surface for placing printed or graphic indicia of any desired kind.

The palm portion 12 opposite the fingers 13 includes an integral extended portion 22. The extended portion 22 is provided with a through hole 23 through which suitable attachment means, such as a bead chain 24, may be inserted to enable the glove conditioner to be hung from a suitable support. The chain 24 may be used, for example, to attach the glove conditioner to a golf bag or the like.

Various modes of carrying out the present invention are contemplated as being within the scope of the following claims particularly pointing out and distinctly claiming the subject matter which is regarded as the invention.

I claim:

1. A conditioner for a golf glove comprising:

a solid wooden body shaped in the form and size of a hand having a palm portion and a plurality of fingers extending from one end of the palm portion;

manually operable clip means attached to one side of the palm portion remote from said fingers for receiving and holding the glove slipped onto the body, said clip means comprising a pivotable spring clip having a leg which is spring biased into holding contact with said palm portion.

2. The apparatus as set forth in claim 1 wherein said body is flat and said fingers are parallel to one another.

3. The apparatus as set forth in claim 2 wherein there are three fingers.

4. The apparatus as set forth in claim 1 wherein said body is made of aromatic cedar.

5. The apparatus as set forth in claim 1 wherein said body includes an extended portion extending integrally from the palm portion opposite the fingers.

6. The apparatus as set forth in claim 5 including attachment means on said extended portion for hanging the conditioner on a support.

7. The apparatus as set forth in claim 1 wherein said leg includes an outer surface portion containing indicia.

* * * * *